US009332596B2

(12) United States Patent
Rydin

(10) Patent No.: US 9,332,596 B2
(45) Date of Patent: May 3, 2016

(54) MICROWAVE OVEN

(71) Applicant: Whirlpool Corporation, Benton Harbor, MI (US)

(72) Inventor: Patrik Rydin, Norrkoping (SE)

(73) Assignee: Whirlpool Corporation, Benton Harbor, MI (US)

( * ) Notice: Subject to any disclaimer, the term of this patent is extended or adjusted under 35 U.S.C. 154(b) by 314 days.

(21) Appl. No.: 13/917,700

(22) Filed: Jun. 14, 2013

(65) Prior Publication Data

US 2014/0151369 A1 Jun. 5, 2014

(30) Foreign Application Priority Data

Jun. 14, 2012 (EP) ..... 12171920

(51) Int. Cl.
*H05B 6/64* (2006.01)
*H05B 6/68* (2006.01)
*H05B 6/66* (2006.01)

(52) U.S. Cl.
CPC ..... *H05B 6/6417* (2013.01); *H05B 6/666* (2013.01)

(58) Field of Classification Search
CPC ..... H05B 6/666; H05B 6/6417
USPC ..... 219/724, 702, 722, 723; 200/50.02, 200/50.08, 50.09, 50.1, 50.12, 50.13, 50.14, 200/50.16
See application file for complete search history.

(56) References Cited

U.S. PATENT DOCUMENTS 4,504,719 A * 3/1985 Taylor et al. ..... 219/724
5,132,503 A * 7/1992 Lee ..... 219/723
6,229,129 B1 5/2001 Yoshida

FOREIGN PATENT DOCUMENTS

DE 4040424 A1 6/1992

OTHER PUBLICATIONS

European Patent Application No. 12171920.7 filed Jun. 14, 2012, applicant: Whirlpool Corporation. European extended search report on same dated Nov. 12, 2012.

* cited by examiner

*Primary Examiner* — Quang Van

(57) ABSTRACT

A microwave oven has an oven chamber, a door hinged to the chamber, and at least one door position switch. The switch provides a signal on door position to a central process unit of the oven. A door position switch assembly includes the switch mounted on the door and adjacent a sliding cover element that is adapted to protect the switch in an open configuration of the door and a first protruding element adapted to move the sliding cover element when the door is closed on the oven chamber in order to make the switch accessible. Additionally, a second protruding element may be included that is adapted to actuate the switch in its accessible configuration.

14 Claims, 3 Drawing Sheets

MICROWAVE OVEN

TECHNICAL FIELD

The present invention relates to a microwave oven comprising an oven chamber, a door hinged to said chamber and switches for providing signals on door position to a central process unit of the oven.

BACKGROUND

Existing door locking systems historically have been very complex in terms of part number count, cost and long tolerance chains. Moreover, different norms for products to be sold in Europe or USA make the design of door locking systems and related switches are not a global one, with a consequence of increasing complexity and cost. The known locking systems are pretty much the same. They all are using a cam wheel movement to activate the switches in the system. These known systems have the disadvantage of being very complex, with a number of pieces ranging from 25 to 40.

SUMMARY

It is therefore an object of the present invention to provide a microwave oven with a locking switch system with a very low number of pieces, therefore reducing the overall cost but maintaining or increasing the reliability of the known systems. According to the invention, such object is reached thanks to the features listed in the appended claims.

The technical solution according to the invention have several advantages: a low cost due to a reduced number of parts, a good appearance of the cavity front face, i.e. with no visible fasteners, a high reliability, a process robust design, an expected number of cycles (door open and closed) higher than 100 000, an easy electrical accessibility in production line, and a shorter mechanical tolerance chain.

One of the main features of the solution according to the invention is a single new functional component added to the locking system concept, i.e. a sliding cover element (a sort of moving eyelid) which protects a micro-switch of the system. Such sliding cover element is moved by a dedicated actuator protruding from the rear face of the door, a second actuator protruding from the rear face of the door entering an opening created by the movement of the sliding cover for actuating the micro switch. The sliding movement of the sliding cover element and the actuation of the micro switch are carried out in a close sequence of events. Alternatively the two protruding actuators can be also carried by the body of the oven, and in this case the micro switch is carried out by the door.

According to another feature of the present invention, the system comprises a second micro switch supported by the oven chamber and adapted to be driven by a movable rotating element hinged to the oven chamber and having a portion, in the open configuration of the door, protruding from the chamber.

BRIEF DESCRIPTION OF THE DRAWINGS

Further advantages and features according to the present invention will be clear from the following detailed description, with reference to the attached drawings, in which.

DETAILED DESCRIPTION

With reference to the drawings, an L-shaped component 10 is mounted to the oven chamber front (not shown) so that a side 10*a* is substantially flush with the annular rim on which the door rest when it is in a closed configuration. On a second side 10*b* of the component there are mounted three snap-action switches, or micro switches, and particularly a so called primary switch 12, a secondary switch 14 and a monitor switch 16 whose function is well known to the person skilled in the art of microwave oven. For sake of clarity, electrical wires connected to switches have been omitted.

Figure 1:
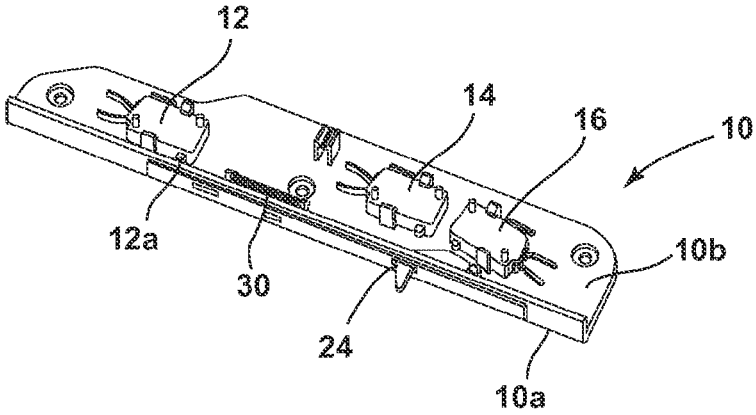
FIG. 1 is a perspective view of a component of a microwave oven according to the invention, which has to be mounted on the oven chamber front portion.
Figure 2:
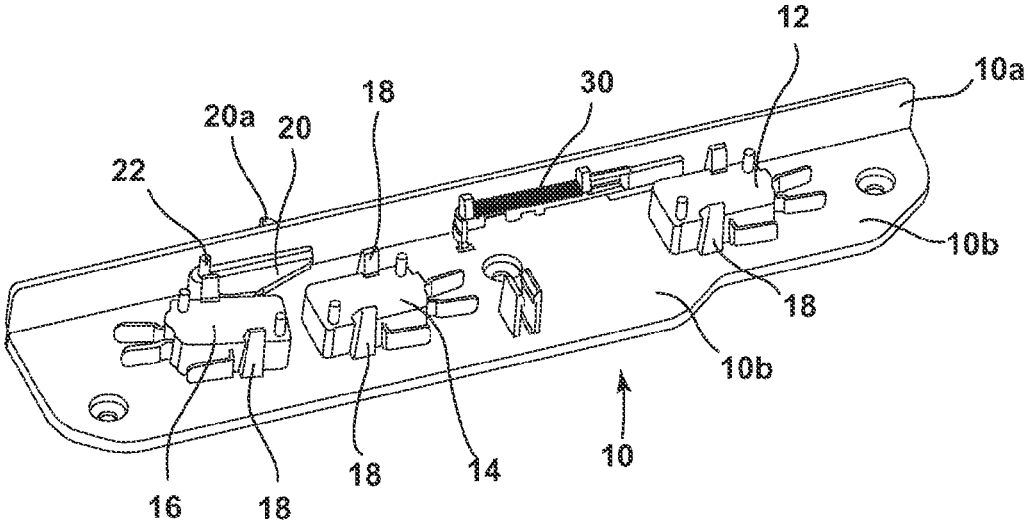
FIG. 2 is a perspective view of the same component of FIG. 1, from another point of view.

The three above micro switches are rapidly mounted on the component 10 by means of elastic hooks 18 which are obtained integrally with the component (for instance in the injection molding process when the component is made of a polymeric material) and which snap engage the bodies of the micro switches. The secondary and monitor switches 14, 16 are operated by a rotating lever 20 hinged in 22 to the side 10*b* of the component 10 and having an actuator portion 20*a* protruding from an aperture 24, in the open configuration of the door shown in FIGS. 1 and 2. When the door is in a closed position (FIG. 7), the lever 20 activates in sequence the monitor switch 16 and then the secondary switch 14 in a way one skilled in the art should appreciate.

Figure 3:
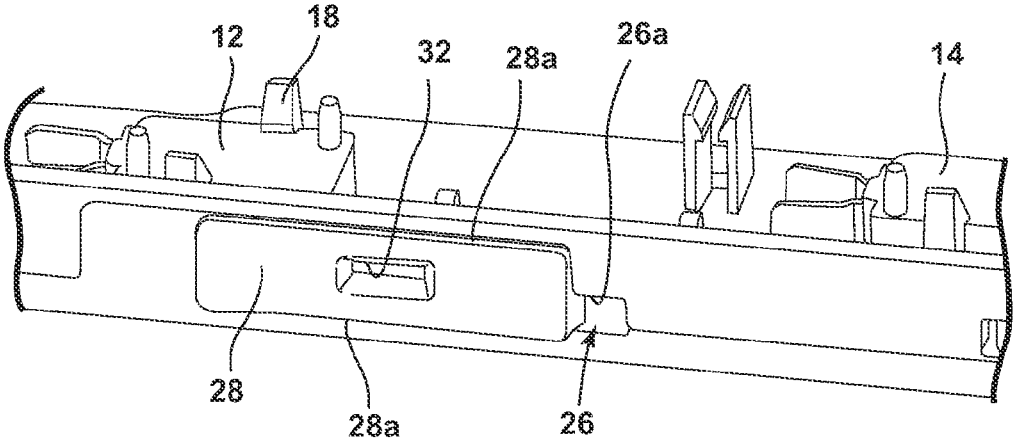
FIG. 3 is an enlarged view, from a third point of view, of a detailed portion of the component of FIGS. 1 and 2.
Figure 4:
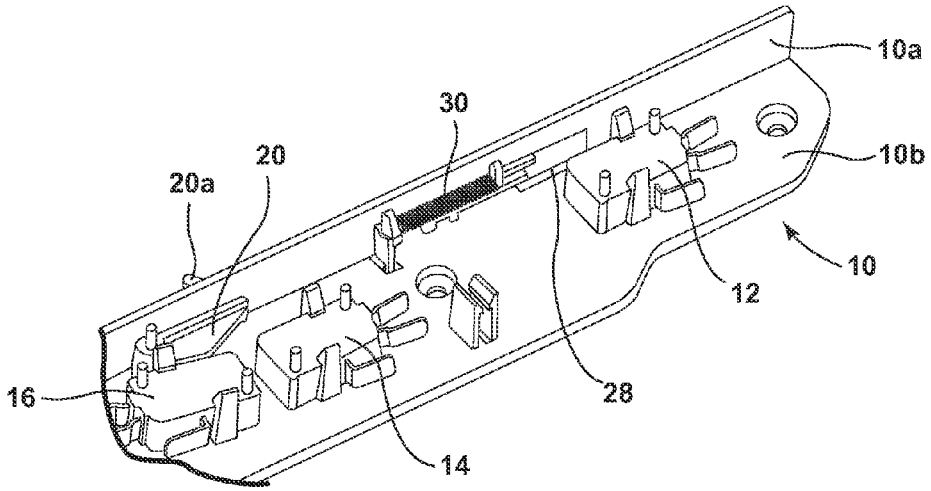
FIG. 4 is an enlarged view of FIG. 2.

The primary switch 12 is adjacent an elongated rectangular aperture 26 provided in the face 10*a* of the component 10 which, in the open configuration of the door, is covered, in a zone adjacent the primary switch 12, by a sliding cover or "eye lid" 28. The sliding cover 28 is preferably made of a polymeric material and presents longitudinal rails 28*a* adapted to slide on corresponding edges 26*a* of the aperture 26. The rails 28*a* maintain the sliding cover 28 on the component 10 and, at the same time, allow the longitudinal sliding movement thereof. The retracted position of the sliding cover 18, i.e. when the door is open, is shown in FIG. 3, where it is clearly shown that the primary switch 12 is protected and concealed. This makes the primary switch 12 tamper proof according to both UL and IEC requirements.

Figure 5:
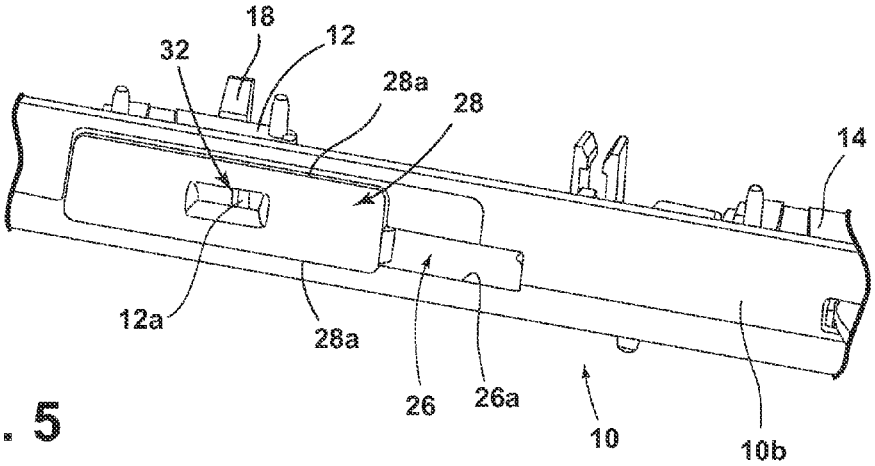
FIG. 5 is a perspective view similar to FIG. 3 but in a second configuration (door closed)
Figure 6:
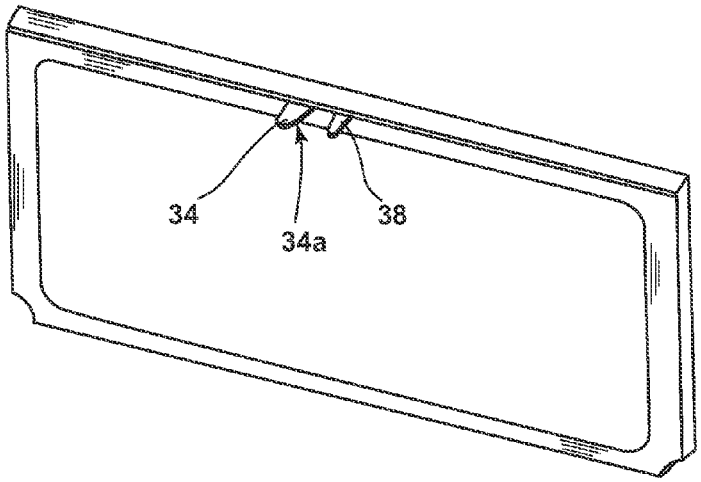
FIG. 6 is a perspective view of a annular frame mounted on the rear face of the door of the microwave oven according to the invention.

The sliding cover 28 is maintained in position by a spring 30 interposed between the component 10 and the sliding cover 28. This latter is provided with an opening 32 whose function will be clear from the following description. When the door is closed, a protruding actuator 34 (FIGS. 6 and 7) shaped as a shark fin and fixed to a door inner frame 36 acts on an edge 28*a* of the sliding cover 28 and forces it, with its curved profile 34*a*, to move sidewise (FIG. 5). During such sidewise movement of the sliding cover 28, the protruding actuator penetrates in the growing opening 26 left free by the sliding cover 28. During such movement, and particularly at the end thereof, an actuator button 12*a* of the switch 12 is exposed through the opening 32, which thereby enables an actuator pin 38 fixed on the inner frame 36 of the door (and adjacent the protruding actuator 34) to activate the primary switch 12. It is clear that the sliding movement of the cover 28 and the insertion of the actuator pin 38 are carried out in a continuous sequence.

Figure 7:
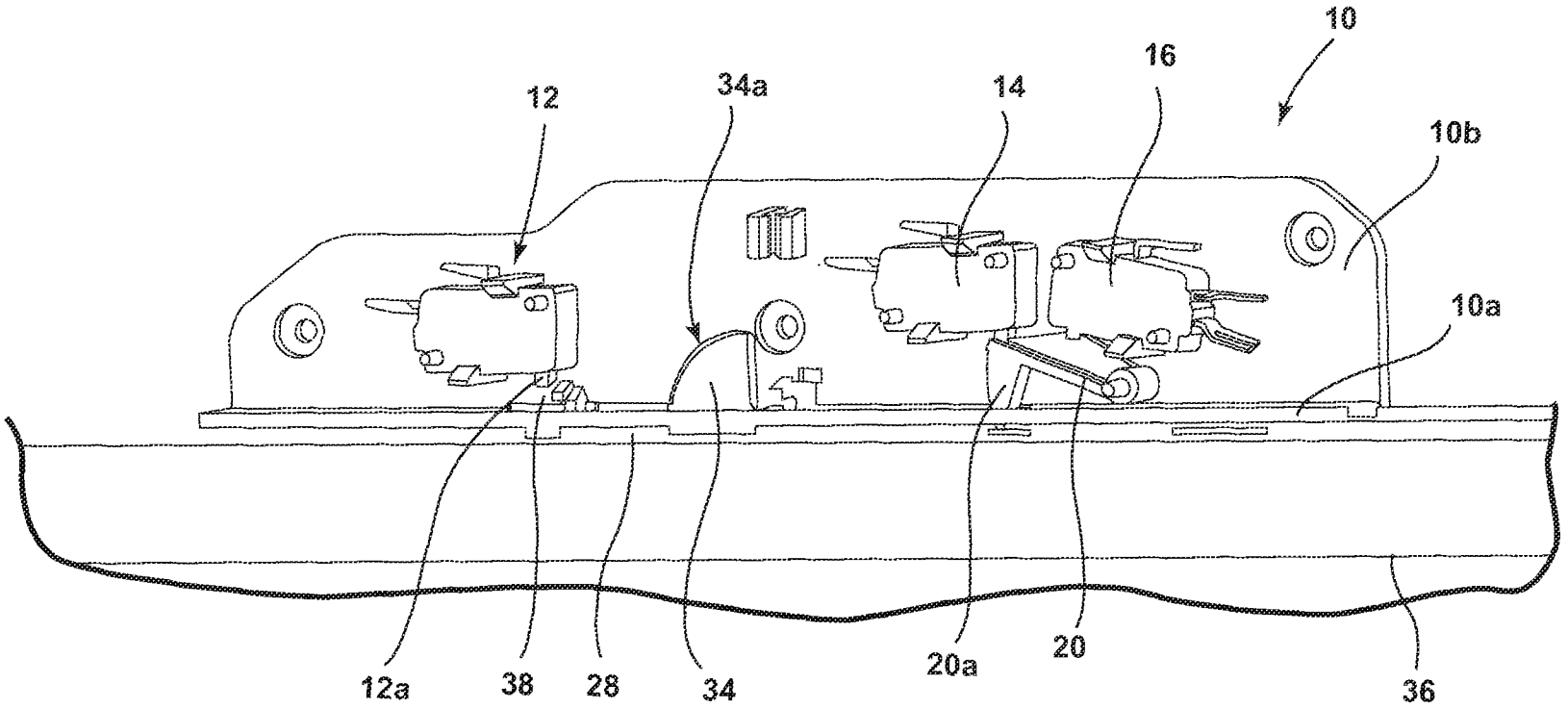
FIG. 7 is a perspective view of a detail of the door and of the front portion of the oven chamber in a closed configuration of the door.

FIG. 7 shows the switch system when the door is in its closed position. The door is maintained in such close position via elastic hinges (not shown). The fin 34 has moved the sliding cover 28 sideways and all three switches 12, 14 and 16 have been activated, therefore providing the central process unit of the oven with signals indicative of the closed configuration of the oven. In details, the secondary and monitor switches 14, 16 are activated by the lever 20 and the primary switch 12 by the actuator pin 38 from the inner frame 36 of the door.

From the above description is clear how the number of pieces involved in the design of the switch is extremely low, therefore providing a new way of addressing the mechanical and electrical complexity of a door locking system for a microwave oven. Even if in the above description the sliding cover is associated to the primary micro switch, it could be also associated to any other switch of the switch assembly, for instance the secondary or the monitor switch.

I claim:

1. A microwave oven, comprising:

an oven chamber;

a door hinged to the oven chamber movable between an open position and a closed position;

a component mounted in the microwave oven and having an elongated aperture;

at least one switch mounted to the component adjacent the elongated aperture, and configured to provide a door position signal to a central process unit when activated;

a sliding cover element mounted adjacent the switch, and biased to a retracted position where the elongated aperture is covered to protect the switch in the open position of the door; and a protruding element on the door positioned to engage and move the sliding cover element as the door is moved to the closed position in order to make the switch accessible for activation.

2. The microwave oven according to claim 1, further comprising an actuator pin on the door to actuate the at least one switch through the elongated aperture only when the door is in the closed position.

3. The microwave oven according to claim 2, wherein the sliding cover element presents an opening through which, in the closed position of the door, the actuator pin actuates the switch.

4. The microwave oven according to claim 1, wherein the protruding element is fin-shaped and presents a curved edge adapted to cooperate with an edge of the sliding cover element.

5. The microwave oven according to claim 1, wherein the component is L-shaped and mounted at a front portion of the oven chamber.

6. The microwave oven according to claim 5, further comprising a spring element between the sliding cover element and the L-shaped component to bias the sliding cover element.

7. The microwave oven according to claim 1, further comprising: a second switch supported by the oven chamber, the second switch adapted to be driven by a rotating element, the rotating element hinged to the chamber and having a portion protruding from the chamber when the door is in the open position.

8. The microwave oven according to claim 7, further comprising a third switch configured adjacent the rotating element, wherein the rotating element is adapted to drive the third switch.

9. A microwave oven door indicating assembly, comprising:

an L-shaped component configured to be mounted on a front portion of a microwave oven chamber and having an elongated aperture;

at least one switch mounted to the L-shaped component adjacent the elongated aperture, and configured to provide a door position signal to a central process unit when activated;

a sliding cover element mounted adjacent the switch, and biased to a retracted position where the elongated aperture is covered to protect the switch when a door to the microwave oven chamber is open; and wherein the at least one switch is positioned so that a protruding element on the microwave oven door will engage and move the sliding cover element as the microwave oven door is moved to a closed position in order to make the switch accessible for activation.

10. The microwave oven door indicating assembly according to claim 9, wherein the sliding cover element has an edge positioned so that a curved edge on the protruding element cooperates with the edge to move the sliding cover element away from the retracted position.

11. The microwave oven door indicating assembly according to claim 9, wherein the cover element includes an opening through which, in a closed configuration of the door, an actuating pin on the microwave oven door will engage and move the sliding cover element as the door is moved to a closed position in order to actuate the at least one switch.

12. The microwave oven according to claim 9, further comprising a spring element between the sliding cover element and the L-shaped component to bias the sliding cover element.

13. The microwave oven according to claim 9, further comprising: a second switch on the L-shaped component, the second switch adapted to be driven by a rotating element, the rotating element hinged to the L-shaped component and having a portion protruding therefrom when the microwave oven door is in an open configuration.

14. The microwave oven according to claim 13, further comprising: a third switch configured adjacent the rotating element, wherein the rotating element is adapted to drive the third switch.

* * * * *